United States Patent [19]

Heiser et al.

[11] Patent Number: 4,496,289

[45] Date of Patent: Jan. 29, 1985

[54] DEVICE FOR CONTROLLING AND/OR MEASURING OPERATIONAL PARAMETERS OF AN AXIAL PISTON MACHINE

[75] Inventors: Joachim Heiser, Stuttgart; Gerhard Wilke, Korntal, both of Fed. Rep. of Germany

[73] Assignee: Robert Bosch GmbH, Stuttgart, Fed. Rep. of Germany

[21] Appl. No.: 427,265

[22] Filed: Sep. 29, 1982

[30] Foreign Application Priority Data

Mar. 8, 1982 [DE] Fed. Rep. of Germany ..... 3208250

[51] Int. Cl.[3] ..... F04B 1/26

[52] U.S. Cl. ..... 417/217; 60/447; 60/449; 60/452; 417/222

[58] Field of Search ..... 417/218–222; 60/445–452; 73/789

[56] References Cited

U.S. PATENT DOCUMENTS

| | | | |
|---|---|---|---|
| 3,474,237 | 10/1969 | Hastings | 73/789 X |
| 3,788,775 | 1/1974 | Leutner et al. | 417/222 |
| 3,864,915 | 2/1975 | Metailler | 60/468 |
| 3,884,038 | 5/1975 | Forster et al. | 60/431 |
| 4,074,529 | 2/1978 | Budzich | 60/445 |

FOREIGN PATENT DOCUMENTS 3004592 8/1981 Fed. Rep. of Germany .

*Primary Examiner*—Edward K. Look

*Attorney, Agent, or Firm*—Michael J. Striker

[57] ABSTRACT

Disclosed is a device for controlling or measuring operational parameters of an axial piston machine. The tilting plate which engages and adjusts the stroke of the piston is provided with two opposite pivot pins supported in fixed bearings. At least one pivot pin is provided with a shearing stress sensor preferably in the form of a magnetoelastic feeler which produces electrical signals the pulsation of which is indicative of rotational speed and the magnitude of the signal is proportional to pressure applied by the pistons and thus to the delivery of the machine. A second sensor is coupled to the tilting plate to indicate the angular displacement of the latter. The output signals from the sensors are separated into the pressure dependent signals, frequency dependent signals and angular displacement signals which upon multiplication are applied to a programmable data processing unit. The output of the unit is supplied to a solenoid operated proportional valve which controls pressure fluid for hydraulic setting motors which adjust the angular displacement of the tilting plate.

13 Claims, 6 Drawing Figures

ELECTRONIC CONTROL UNIT
AXIAL PISTON PUMP
AUXIL PUMP
MATCHING MEMBER
A
D
F
S
π
π
$U_N$
$U_p$
$\pm U_s$
10
11(12)
12
13
14
15
16
17
18
20
37
40
41
42
43
44
45
46
47
47'
50
51
52
53
54
56
57
58
68
69
69
70
72
73
74
76
77
78
79

DEVICE FOR CONTROLLING AND/OR MEASURING OPERATIONAL PARAMETERS OF AN AXIAL PISTON MACHINE

BACKGROUND OF THE INVENTION

The present invention relates in general to axial piston machines and in particular to a device for controlling or regulating operational parameters such as pressure, rotary speed, power and delivery of such a machine as well as measuring and processing of these parameters. In particular the invention is concerned with an axial piston machine of the type having a tilting plate supported by means of diametrically opposed pivot pins in housing bearings and controlled by adjusting means which control the angular position of the tilting plate in response to control signals.

Known control devices of this type are equipped with electric or electronic sensors for measuring rotary speed and angular position of the tilting plate as well as the hydraulic type sensors for measuring for example the delivery pressure; or if necessary there are also provided mechanical sensors for measuring one of the aforementioned parameters. Due to this large number of various sensors the control device is costly and prone to failure.

SUMMARY OF THE INVENTION

It is therefore a general object of the present invention to overcome the aforementioned disadvantages.

More particularly, it is an object of the invention to provide a control device for axial piston machines which is simpler in structure and more reliable in operation than conventional control devices of this type.

An additional object of this invention is to provide a control device designed in modular form so as to be easily installable in connection with the axial piston machine.

In keeping with these objects and others which will become apparent hereafter, one feature of the invention resides, in an axial piston machine having a tilting plate which is pivotably supported on two diametrically opposed pivot pins and controlled as to its angular position by hydraulically operated control means, comprising an electronic data processing means for producing output signals applied to the adjusting means; at least one of the pivot pins of the tilting plate cooperating with a sensor which produced data independent of pressure and rotary speed of the machine, and means for feeding the data from the sensor to the data processing means.

By the arrangement of the sensor in connection with the pivot pin of the tilting plate, it is possible to produce output signals indicative of rotary speed, delivery volume and delivery pressure in the form of electrical signals which upon suitable conversion are fed for processing in an electronic data processing unit. The data processing unit controls the tilting plate and thus all desired functions of the machine according to an entered program. In this manner, a substantial simplification of the control system is achieved and also the accessability and reliability thereof is improved. The device has a further advantage that its elements have modular construction which may be easily replaced or combined and which is easily applicable to different machines.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
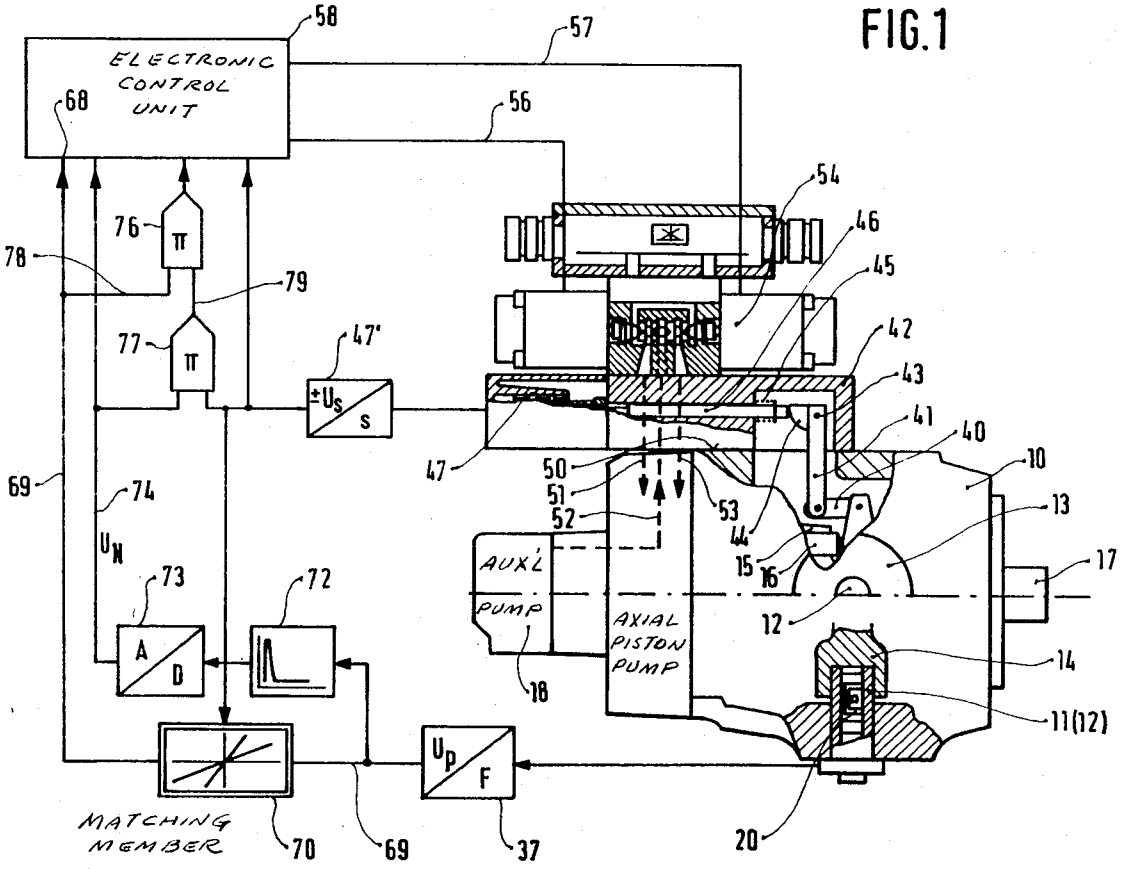
FIG. 1 is a schematic block diagram of the control system of this invention shown in connection with an adjustable axial piston machine; the machine is shown in partly sectional side views.

In FIG. 1, reference numeral 10 indicates a conventional axial piston pump in which the dash-dot line indicates axis of rotation of driving shaft 17. The part of the pump above the axis is shown in a side view whereas the part below the axis is depicted in sectional top view. Housing 10 of the machine supports in conventional manner on two diametrically opposed pins 11 and 12 the tilting plate 13. The pins 11 and 12 project into a roller or slide bearings 14 formed on the tilting plate 13. A cylinder barrel 15 with pistons 16 is mounted on the driving shaft 17 and rotates therewith. The ends of the pistons contact the tilting plate 13 in conventional manner. The driving shaft 17 drives also an auxiliary pump 18 which delivers pressure fluid to tilting motors (not illustrated) which adjust the angular position of the tilting plate 13.

Figure 2:
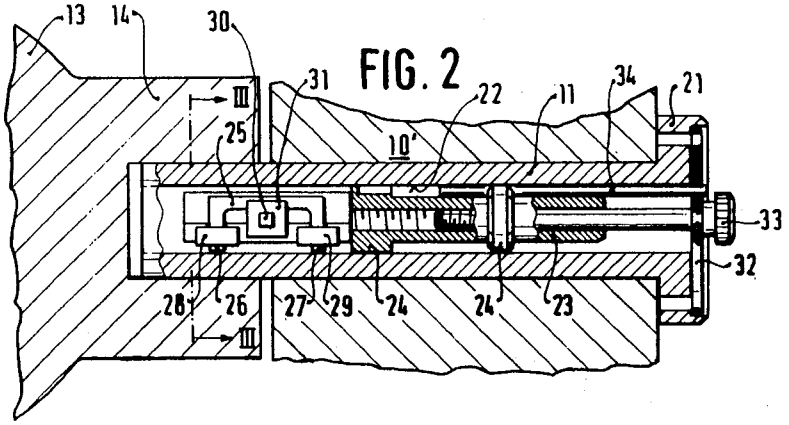
FIG. 2 is a sectional side view of a sensor arranged in a pivot pin of the tilting plate shown on an enlarged scale.

As it will be seen from FIG. 2, at least one of the pins 11 and 12 is formed with an axial blind bore 22 housing a magnetoelastic sensor 20. The design of this sensor is known from prior art (German Offenlegungsschrift No. 3,004,592) and its operation is explained in FIGS. 2–5. The pin 11 which in this example houses the sensor, is formed at its end opposite the bearing 14 with a flange 21 resting on the outer surface of housing part 10'. The sensor includes a coil carrier 23 which is slidably guided in the blind bore 22 on two piston like sections 24. The end portion of the coil carrier 23 which projects in the bearings 14 of the tilting plate 13, supports a basically E-shaped magnetic core 25, which bridges the gap between the bearing part 14 and housing part 10'. In this region pin 11 is subject to maximum shearing stress. The two outer arms 26 and 27 of the magnetic core 25 are provided with secondary coils 28 and 29 respectively. The central arm of the E-shaped magnetic core 25 as seen from FIGS. 2 and 4 is angularly shifted relative to the plane of the end arms 26 and 27 about 90° and is provided with a primary coil 31. The magnetic core 25 is mounted on the carrier 23 in such a manner that the faces of respective arms 26, 27 and 30 are in close proximity to the inner wall of the blind bore 22. The outer end of the blind bore is closed by a cover plate 32 secured to the flange 21. The center of cover plate is formed with a passage for setting screw 33 engaging a threaded hole in the coil carrier 23 so that the axial position of the latter in the bore 22 can be adjusted. In order to keep the coil carrier 23 in a predetermined angular position relative to the pin 11, a guiding rod 34 projects from the cover plate 32 into the interior of the bore 22 and slidably engages a recess in the first piston-like section or land 24 of the coil carrier 23. Electrical terminals for primary coil 31 and for the secondary coils 28 and 29 are lead out of the bore 22 in any suitable, not illustrated manner.

Figure 3:
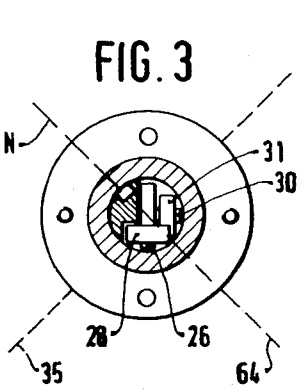
FIG. 3 is a sectional view of the sensor taken along the line III—III of FIG. 2.
Figure 4:
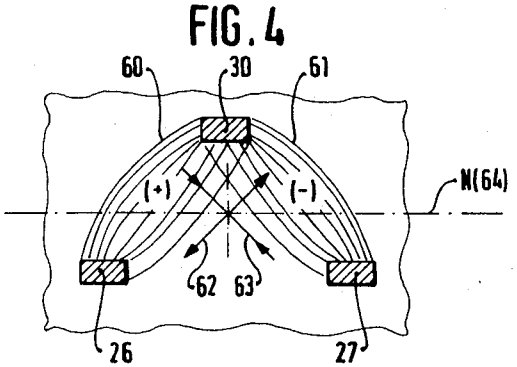
FIG. 4 shows on an enlarged scale the operation of the sensor of FIG. 2.

As indicated in FIG. 3, a force acts on pivot pin 11 in the direction of dashed line 35. As a consequence, magnetic flux lines in the pin 11 pass through a region of higher shearing stress but of lower transverse bending stress so that vectors of the shearing stress and of the magnetic field are oriented in the same direction. The pivot pins 11 (and/or 12) are made preferably of a soft magnetic material which optimizes the aforementioned magnetic flux condition. A conductor 36 leads from the magnetic sensor 20 to a frequency or pressure to voltage converter 37 (FIG. 1).

A radially projecting lug 39 is formed on the circumference of the tilting plate 13 at a location which is shifted about 90° relative to the pivot pins 11 and 12. This lug which during the tilting movement of the plate 13 moves along a circular path, is linked via an intermediate link 40 to one arm of a lever 41 which is pivotable about stationary shaft 43 mounted on an adapter housing 42. Accordingly, depending on the angular adjustment of the tilting plate and thus on the delivery of the pump, the angular displacement of the tilting plate is transmitted to a cam 44 secured to the other arm of lever 41. A cam follower pin 46 is guided in a corresponding bore in the adapter housing 42 and is biased by a spring 45 against the cam 44. The opposite end of the cam follower pin 46 is coupled to an inductive displacement sensor 47 operating on inductive principle for example and delivering a corresponding electrical signal to a displacement-voltage converter 47'. The cam 44 is shaped preferably in such a manner that the maximum angular displacement of the tilting plate 13 produces the maximum stroke of the follower pin 46 resulting in the maximum signal at the displacement sensor 47. The electrical signal at the output of the converter 47' fulfills the following relationship:

$$\pm U_S = U_{Smax} \frac{V_H}{V_{Hmax}}$$

wherein $V_H$ denotes the delivered volume.

The adapter housing 42 is mounted on a flange 50 which is also formed with connections for hydraulic channels 51, 52 and 53. The channel 52 leads to the auxiliary pump 18 whereas channels 51 and 53 are connected to the non-illustrated tilting motors for the tilting plate 13 and are controlled by a solenoid operated proportional valve 54. The valve 54 regulates pressure fluid delivered from the auxiliary pump 18 to the setting motors. Solenoids of the proportional valve 54 are energized via conduits 56 and 57 leading to an electronic control unit 58. Preferably, the control unit 58 is arranged in the casing of the proportional valve 54. The operation of control unit 58 which supplies the control signals for the solenoids of valve 54 will be explained in greater detail below.

Figure 5:
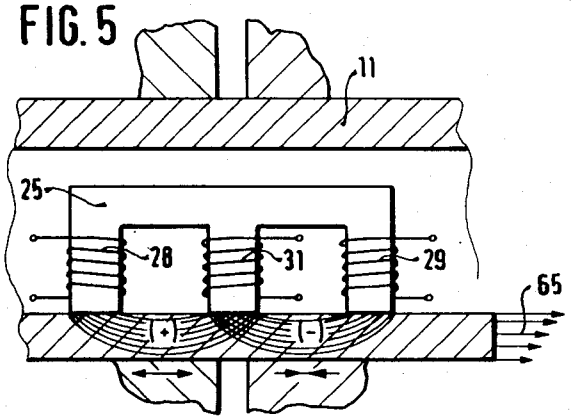
FIG. 5 is another view of the sensor of FIG. 2.
Figure 6:
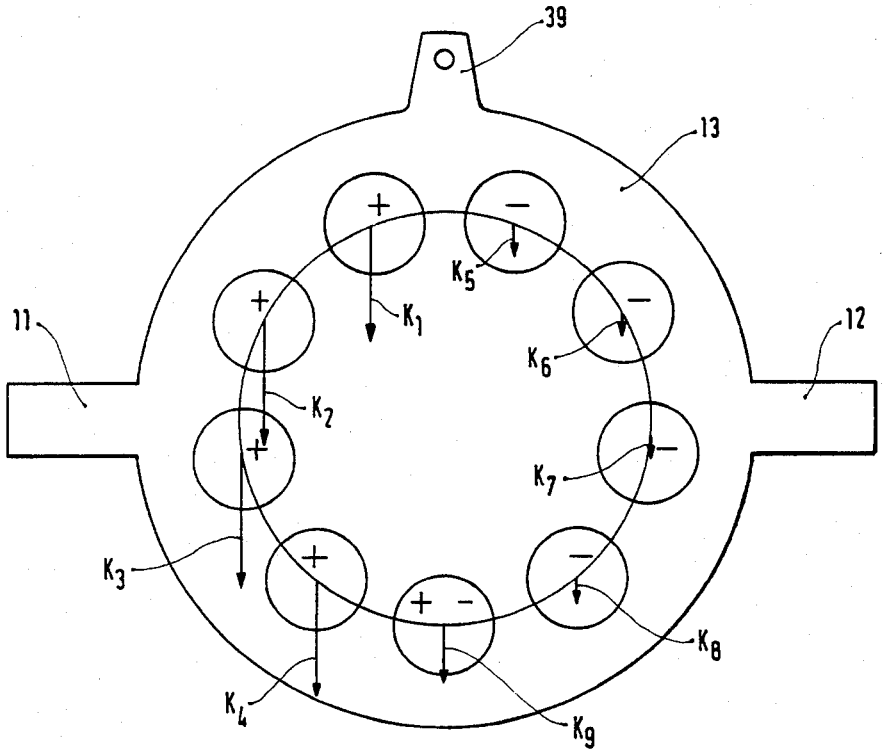
FIG. 6 is a schematic illustration of the tilting plate in an axial piston machine.

The pressure measurement at the axial piston pump is accomplished by means of the aforementioned magnetoelastic sensor 20. It will be noted that the sum of pressure forces exerted by all pistons is transmitted upon the two diametrically opposed pivot pins 11 and 12. Inasmuch as these pressure forces are generated substantially by the pump pistons at the high pressure side, the bearings 14 of the pivot pins are exposed to a higher load at the side of the delivering pistons K1 to K4 than at the suction side including the pistons K5 to K9 (FIG. 6). This load difference has the consequence that upon the change of the direction of delivery the sides of higher load are also reversed. The measurement of forces acting on the bearings 14, preferably on the high pressure side of the bearing of the tilting plate or of the corresponding side of the pivot pin, thus produces a signal or information which is proportional to the exerted pressure or to the rotary moment of the pump. As mentioned above, in order to measure such a signal at least one pivot pin (pin 11) is employed for receiving the magnetoelastic sensor 20. The sensor 20 makes use of the effect that the permeability of steel changes as a function of bending, torsional or shearing stresses. For detecting such changes, the E-shaped transformer system 25 has its primary and secondary coils arranged in such a manner that the magnetic flux is introduced in the neutral zone of bending stresses. An additional measurement of the influence of bending stresses would namely produce unacceptably high errors. The magnetic flux is introduced by applying a constant voltage to the primary coil 31 and the measuring voltage is picked up from the two outer secondary coils 28 and 29. The two secondary coils are interconnected in such a manner that the sensor operates according to a differential stresses. As indicated in FIGS. 4 and 5, magnetic flow lines 60 are generated between the transformer arms 26 and 30. Also between the arms 27 and 30 there are produced magnetic flow lines 61 in the material of pivot pin 11. In the range of these magnetic flow lines, due to existing shearing stresses, a tensile stress 62 oriented in the direction between the transformer arms 26 and 30 and at the right angles to the tensile strength, a compressive strain 63 is developed in the direction between the transformer arms 27 and 30. When the direction of forces acting on the tilting plate is changed then the position of the tensile and compressing stresses is also changed and so is the sign of the sensed electrical signals. Due to the magnetoelasticity of the material of the pin element the permeability in the range of the tensile stress 62 is increased whereas in the range of the compressive stress 63 the permeability is decreased. As a consequence, the magnetic coupling between the primary coil 31 and the secondary coils 28 and 29 of the sensor is changed accordingly and a proportional measuring voltage can be derived from the applied stresses. By means of the guide rod 34 which is fixed to the cover plate 32, the magnetic core 25 is always held in such a position that a plane 64 bisecting the angle between the central arm 30 and the end arms 26 and 27 is directed substantially at right angles to the plane 35 of symmetry between the end arms 26 and 27. In this manner it is achieved that the magnetic flux lines 60 and 61 pass through a range of the pivot pin 11 in which the effect of shearing stresses is maximum and the effect of bending stresses is negligible (the neutral zone N). By virtue of the arrangement of the magnetic core 25 together with its primary and secondary coils in the interior of the hollow pivot pin 11 the value of the picked signal is increased inasmuch as shearing stress 65 in a tubular wall increases from the outside to the inside as indicated in FIG. 5. These shearing stresses as mentioned before, are employed for measuring the delivery pressure of the pump and by converting the picked up signal in converter 37, an output voltage $U_l$ is derived which depends on the shearing force in the bearing.

Upon the reversal of the direction of delivery at the same rotary direction of the pump drive, high pressure side and the lower pressure side are then changed. Simultaneously the output signal $U_S$ of the displacement feeler of the tilting plate changes correspondingly both its amplitude and its sign. When a single magnetoelastic sensor is employed for detecting the force in the bearing, reversal of the direction of delivery causes also a change in the relationship between the delivery pressure or the bearing force and the output voltage $U_P$ of the bearing force feeler. For this reason, an adjusting or matching member 70 is connected in conduit 69 from the output of converter 37 to the input 68 of the electronic control unit 58. The matching member 70 received from the displacement converter 47' an output signal $\pm U_S$ and employs this information about the position of the tilting plate for adjusting the sensitivity according to the ratio $$U_{PA}/U_{PE}$$

If both pivot pins 11 and 12 are provided with magnetoelastic sensors the matching member 70 is dispensed with. For determining the power of the pump, information regarding the rotary speed is necessary. This information is acquired in the following manner: As mentioned before, the tilting plate 13 applies against the two pivot pins 11 and 12 a force which is proportional to the delivery pressure. This force is modulated with a pulsation caused by pressure changes in the working cylinders for piston 16 during their comutation with the control plate. At high delivery pressures the amplitude of pulsation amounts about $\pm 13\%$ of the entire force but only at low loads variation will result on the bearings 14 for example due to the preliminary compression in the working cylinders. The frequency of such variations depends on the rotary speed and the number of pistons. For example, in a pump having nine pistons frequency equals $$f=(9n/60)\ \text{Hz}$$

whereby n is the rotary speed.

For measuring rotary speed, the pulsating output voltage $U_P$ of converter 37 is applied through differentiator 72 to a converter 73 where it is converted into an output voltage $U_N$ depending on the rotary speed and the latter is applied through conduit 74 into the input 75 of the unit 58. The mean value of this voltage $U_N$ is indicative of pressure, as explained above, and the frequency of pulsation is indicative of the rotary speed. The differentiator 72 converts these pulses into an analog signal.

The actual value signal for the amount of delivery and power is derived in a known manner by multiplying the position indication, pressure indication and the rotary speed in multipliers 76 and 77. The multiplier 77 combines signals corresponding to the stroke volume and to the rotary speed into an output signal in conduit 79 which indicates delivery value and is applied to the multiplier 76. The other input of multiplier 76 is connected via conduit 78 to conduit 69 and produces at its output a signal indicative of the momentary power.

If, for example, two setting motors are assigned to the tilting plate 13 and connected so as to operate as a double acting setting motor then the control of pressure fluid through such motors is preferably made via a 4/3 control valve. This control valve is solenoid operated by proportional solenoids and is center adjusted by biasing springs; acting as a safeguard against failure.

The electronic control unit 58 is preferably a programmable data processing device programmed for pressure control, volume control, rotary speed control and power control. The output signals are applied as mentioned before via conduits 56 and 57 to the electromagnetic control of the pump.

The device of this invention makes it possible to determine in a very simple manner all essential parameters of the pump, to process the detected data and to control the pump according to a desired program.

Instead of magnetoelastic sensors 20 it is also possible to use strain gauges applied to the inner or outer surface of the pivot pins in its neutral zone. The strain gauges output the same values as the magnetoelastic sensors and these values can be processed in the same manner as described above.

It will be understood that each of the elements described above, or two or more together, may also find a useful application in other types of constructions differing from the types described above.

While the invention has been illustrated and described as embodied in an axial piston pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of the present invention.

What is claimed as new and desired to be protected by Letters Patent is set forth in the appended claims:

1. A device for controlling and/or measuring operational parameters of an adjustable axial piston machine including axial pistons, a tilting plate cooperating with the pistons and being supported for angular displacement on two opposite pivot points, and means for adjusting the angular position of the tilting plate, said device comprising a data processing unit for producing control signals, means controlling said adjusting means in response to said control signals, at least one of said pivot pins being provided with a strain sensor which converts forces acting upon the pin into data indicative of delivery pressure and rotary speed of the machine; means for separating and feeding the data into said data processing means; said one pivot pin having a tubular configuration and being made of a soft magnetic material, said sensor being located in said one pivot pin and including a pick-up transformer operating on magnetoelastic principle and having an open magnetic circuit cooperating with the material of said one pin.

2. A device as defined in claim 1, wherein said open magnetic circuit is in the form of a core defining at least two arms arranged at right angles to each other, one of said arms being provided with a primary coil and the other arm with a secondary coil, and the plane bisecting the angle between the arms being directed substantially perpendicularly to the region of maximum shearing stresses in said pin.

3. A device as defined in claim 2, wherein said open magnetic circuit has the form of an E-shaped core defining two end arms and a central arm, said central arm being provided with a primary coil and the end arms being provided with secondary coils operating according to a differential method.

4. A device as defined in claim 1, wherein said magnetic core is axially displaceable in said tubular pivot pin.

5. A device as defined in claim 4, further including means for adjusting the angular position of the core in said tubular pivot pin.

6. A device as defined in claim 1, further including an angular displacement sensor coupled to said tilting plate.

7. A device as defined in claim 6, wherein said means for separating and feeding the data from said sensors includes a frequency and/or pressure signal converter connected to said pressure and rotary speed sensor, and a converter connected to said angular displacement sensor.

8. A device as defined in claim 7, further including means for adjusting the frequency and/or pressure dependent signal to either signal indicative of the angular displacement of the tilting plate.

9. A device as defined in claim 7, wherein said means for separating and feeding said signals further includes a multiplier for multiplying signals indicative of pressure and of delivery volumes to produce signals indicative of momentary power of the machine.

10. A device as defined in claim 6, wherein said angular displacement sensor is coupled to said tilting plate via a cam arranged to said tilting plate by a two arm lever.

11. A device as defined in claim 10, wherein said angular displacement sensor is located in an adapter housing fastened to said axial piston machine.

12. A device as defined in claim 11, wherein said means for adjusting angular position of said tilting plate includes at least one hydraulic setting motor, an auxiliary pump for delivering pressure fluid to said setting motor and a solenoid operated proportional control valve the solenoids of which are controlled by the output from the data processing means.

13. A device for controlling and/or measuring operational parameters of an adjustable axial piston machine including axial pistons, a tilting plate cooperating with the pistons and being supported for angular displacement on two opposite pivot points, and means for adjusting the angular position of the tilting plate, said device comprising a data processing unit for producing control signals, means controlling said adjusting means in response to said control signals, at least one of said pivot pins being provided with a strain gauge which converts forces acting upon the pin into data indicative of delivery pressure and rotary speed of the machine; means for separating and feeding the data into said data processing means; said one pivot pin having a tubular configuration and said strain gauge being secured to a neutral zone on the upper or inner surface of said one pivot pin.

* * * * *